United States Patent [19]

Bates

[11] Patent Number: 4,765,126

[45] Date of Patent: Aug. 23, 1988

[54] SADDLE

[76] Inventor: Kenneth J. Bates, Lot 2, Glen Road, Darlington, Western Australia, Australia

[21] Appl. No.: 914,943

[22] Filed: Oct. 3, 1986

Related U.S. Application Data

[63] Continuation-in-part of Ser. No. 826,483, Jan. 3, 1986.

[30] Foreign Application Priority Data

May 8, 1984 [AU] Australia ..... PG4882

[51] Int. Cl.[4] ..... B68C 1/02

[52] U.S. Cl. ..... 54/44

[58] Field of Search ..... 54/44, 66

[56] References Cited

U.S. PATENT DOCUMENTS

| | | | |
|---|---|---|---|
| 3,112,592 | 12/1963 | Schindler | 54/44 |
| 3,286,440 | 11/1966 | Walker et al. | 54/44 |
| 3,698,608 | 10/1972 | Entwistle | 54/44X |
| 4,287,705 | 9/1981 | Frost et al. | 54/44 |
| 4,502,266 | 5/1985 | Friedson | 54/44 |

FOREIGN PATENT DOCUMENTS

| | | | |
|---|---|---|---|
| 19019 | 9/1914 | France . | |
| 378365 | 8/1932 | Great Britain . | |
| 2259376 | 9/1974 | West Germany . | |
| 2550521 | 2/1985 | France . | |
| 54195 | 12/1979 | Australia . | |
| 3236079 | 4/1983 | Fed. Rep. of Germany | 54/44 |
| 846844 | 9/1939 | France | 54/44 |
| 1233344 | 5/1971 | United Kingdom . | |

*Primary Examiner*—Robert P. Swiatek

*Attorney, Agent, or Firm*—Harness, Dickey & Pierce

[57] ABSTRACT

A saddle comprises upper and lower saddle coverings formed from composite sheet material consisting of outer fabric layers bonded to an intermediate layer of flexible foam. Preferably, the outer fabric layer consists of synthetic such as nylon and the foam is a closed cell foam.

6 Claims, 9 Drawing Sheets

SADDLE

REFERENCE TO RELATED APPLICATIONS

This application is a continuation-in-part of application No. 826,483 filed Jan. 3, 1986,

BACKGROUND OF THE INVENTION

1. Field of the Invention

The present invention relates to saddles.

2. Description of the Prior Art

In the past saddle construction has been a very time consuming and costly operation with the experienced saddler having to "build up" his saddle on a conventional saddle tree by the addition of webbing, shaped padding and other material. This enables a particular shape of saddle to be formed which then receives a covering of leather and other materials to provide the finished product. In the past the material to be added or "built on" to the saddle tree has been either rivetted, stapled or glued to the wooden saddle tree. More recently saddle trees have been constructed or formed from rigid plastics material with thin carbon rods being inserted in the thinner lighter racing saddles to give the desired strength to the saddle tree. With the introduction of this form of saddle tree, one particular problem has arisen in that material cannot be readily stapled to the tree in the saddle build-up process.

An improved method of constructing a racing saddle and overcoming the above mentioned difficulties is disclosed in our own Australian patent No. 524616 wherein the upper saddle coverings including the seat, backs and upper flaps are formed into a single upper member, the underside saddle coverings including the panel, lining and underflaps are formed into a single underside member, said upper and underside members being secured together around the periphery of the seat to form a pocket thereby enabling a saddle tree to be inserted, said upper and underside members being secured together and to the cantle of the saddle tree to form a saddle.

An object of the invention is to provide a faster, more efficient, and economical saddle construction applicable not only to racing saddles but also to general-purpose and other saddles.

SUMMARY OF THE INVENTION

According to the present invention, there is provided a saddle comprising a saddle tree, and upper and lower saddle coverings secured to the tree, the saddle coverings each being formed from composite sheet material comprising outer fabric layers bonded to an intermediate layer of a flexible foam.

Further according to the invention, there is provided a method of making a saddle comprising providing composite sheet material consisting of cloth covering resilient foam, pressing shaped sections from the sheet material and assembling the sections to form an upper saddle covering unit including a seat, pressing shaped sections from the sheet material and assembling the section to form a lower saddle covering unit including a panel and underflaps providing a saddle tree, and attaching the upper and lower saddle covering units to the tree.

BRIEF DESCRIPTION OF THE DRAWINGS

Embodiments of the invention will now be described by way of example only with reference to the accompanying drawings in which.

Figure 1:
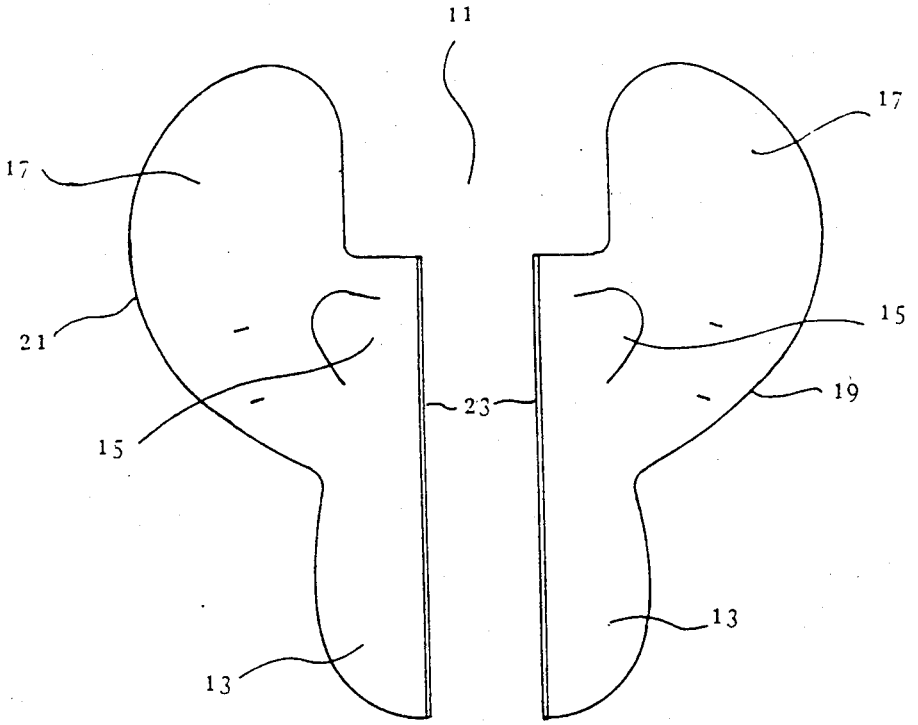
FIG. 1 is a plan view of the two separated halves of the upper saddle covering of a first embodiment of the invention.
Figure 2:
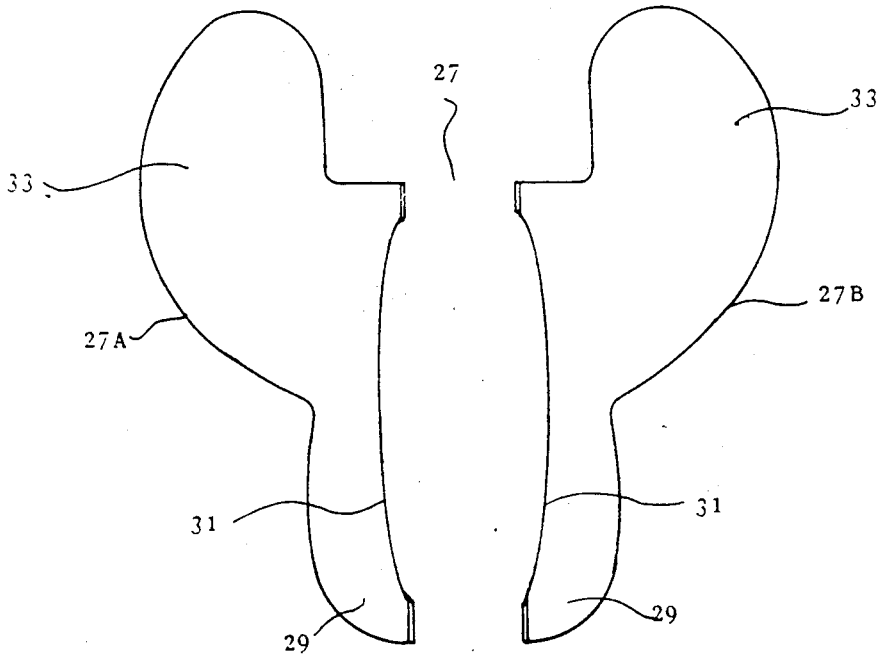
FIG. 2 is a plan view of the two separated halves of the underside saddle covering.
Figure 3:
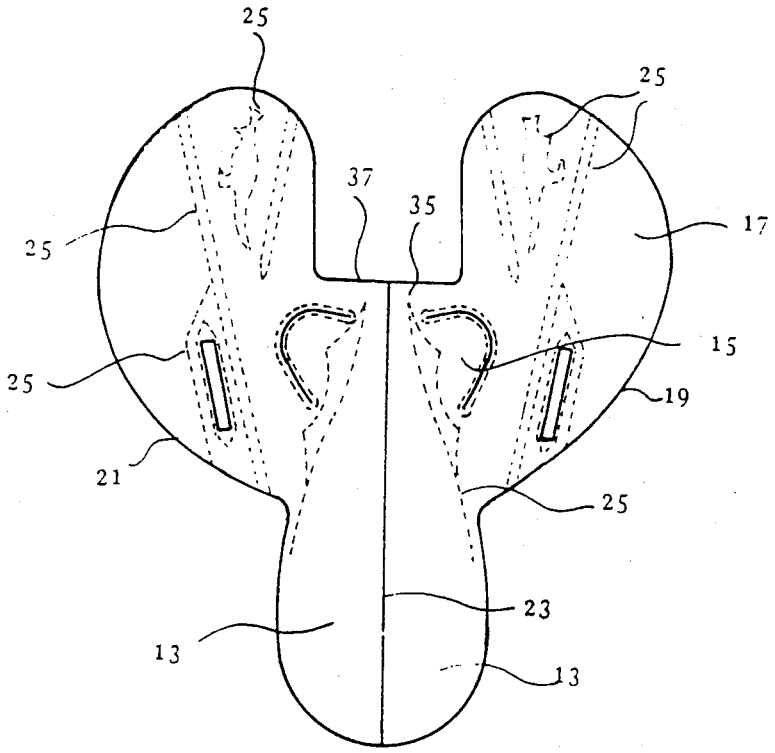
FIG. 3 is a plan view of complete upper covering.
Figure 4:
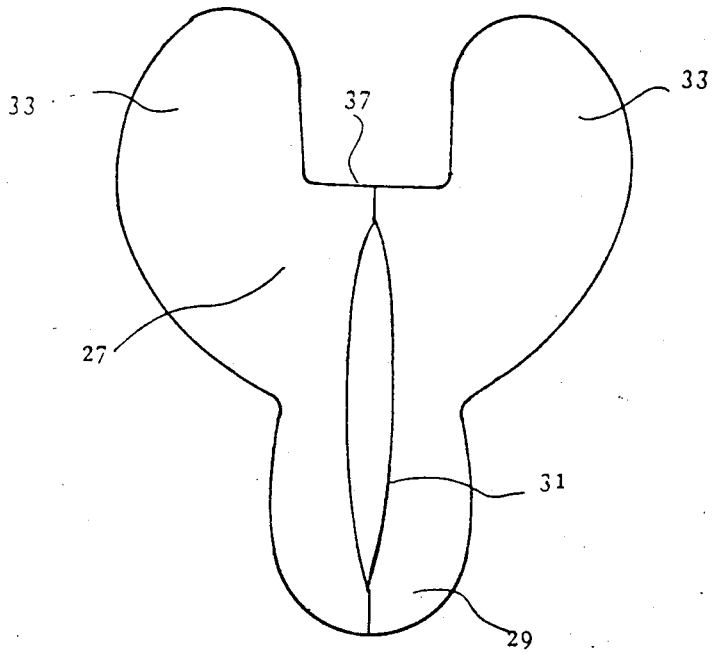
FIG. 4 is a plan view of complete underside covering.
Figure 5:
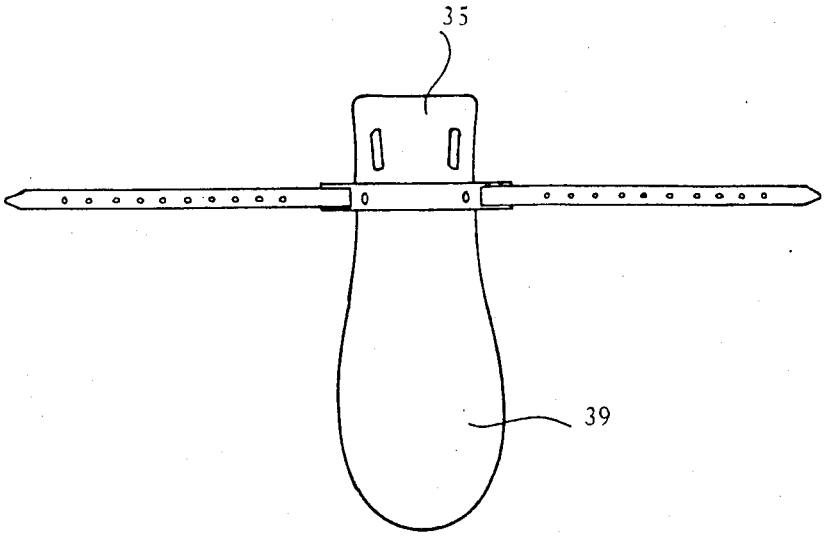
FIG. 5 is a plan view of a saddle tree.
Figure 6:
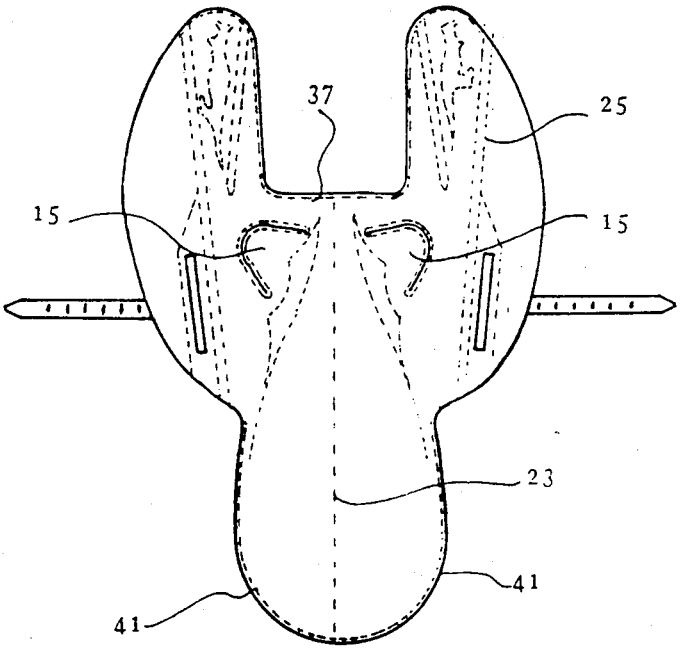
FIG. 6 is a plan view of the completed saddle.
Figure 7:
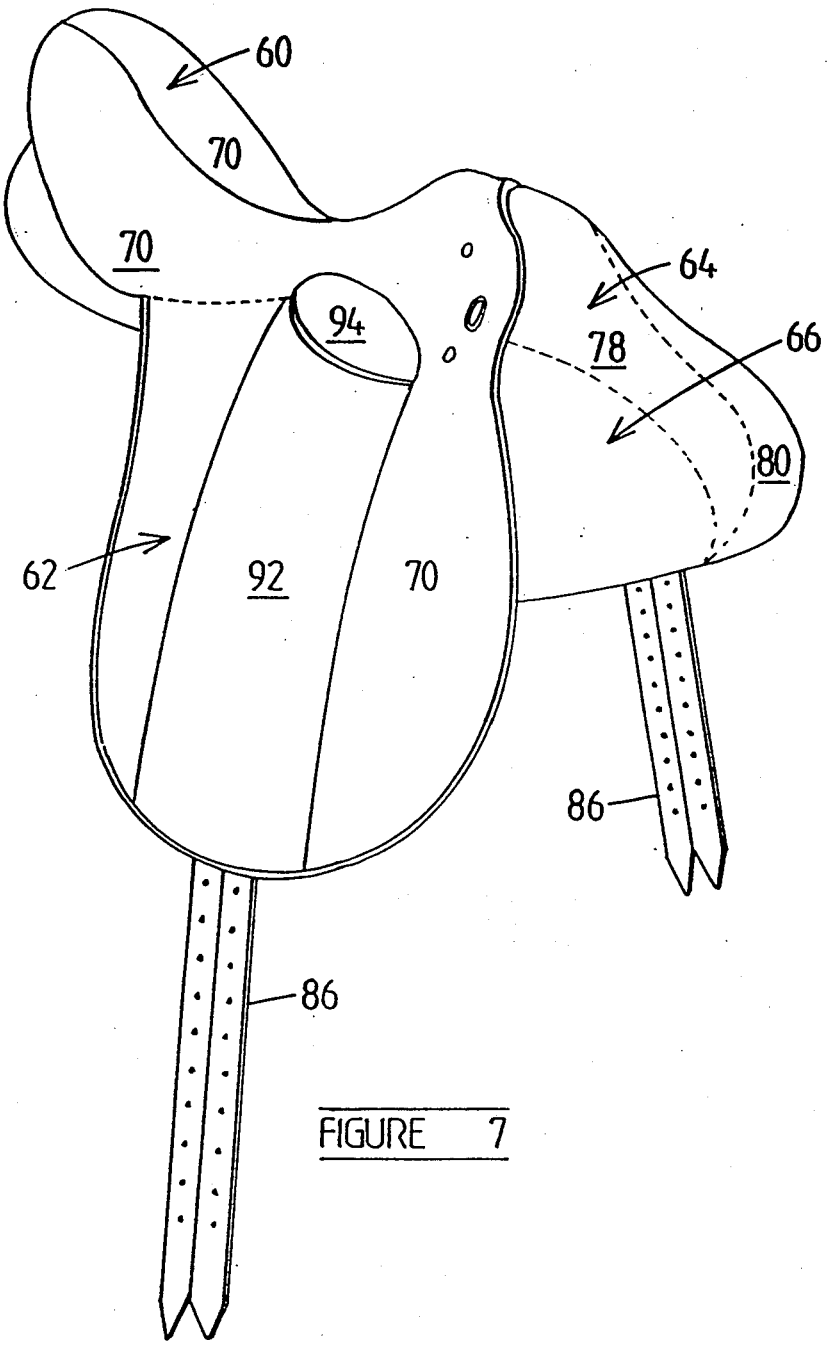
FIG. 7 is a front perspective view of a second embodiment of the invention.
Figure 8:
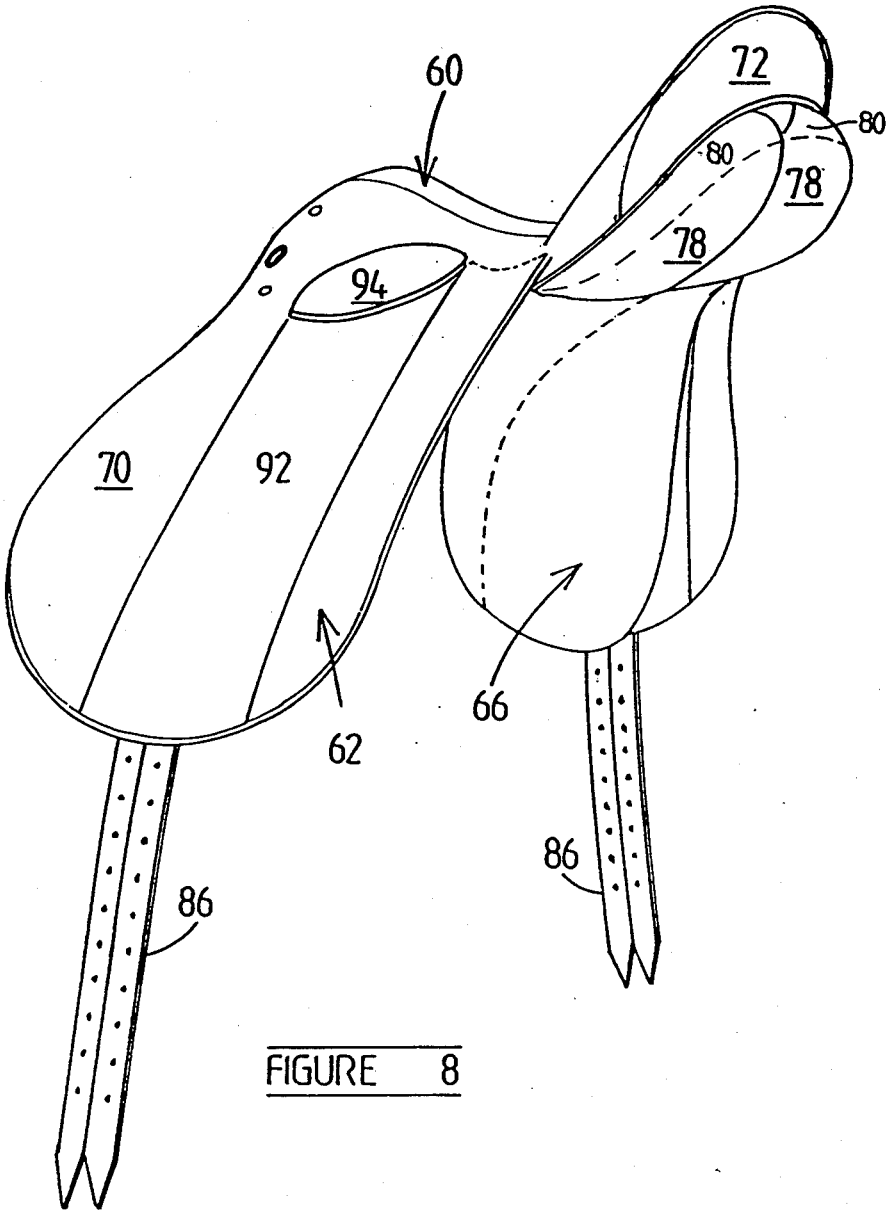
FIG. 8 is a rear perspective view of the second embodiment.
Figure 9:
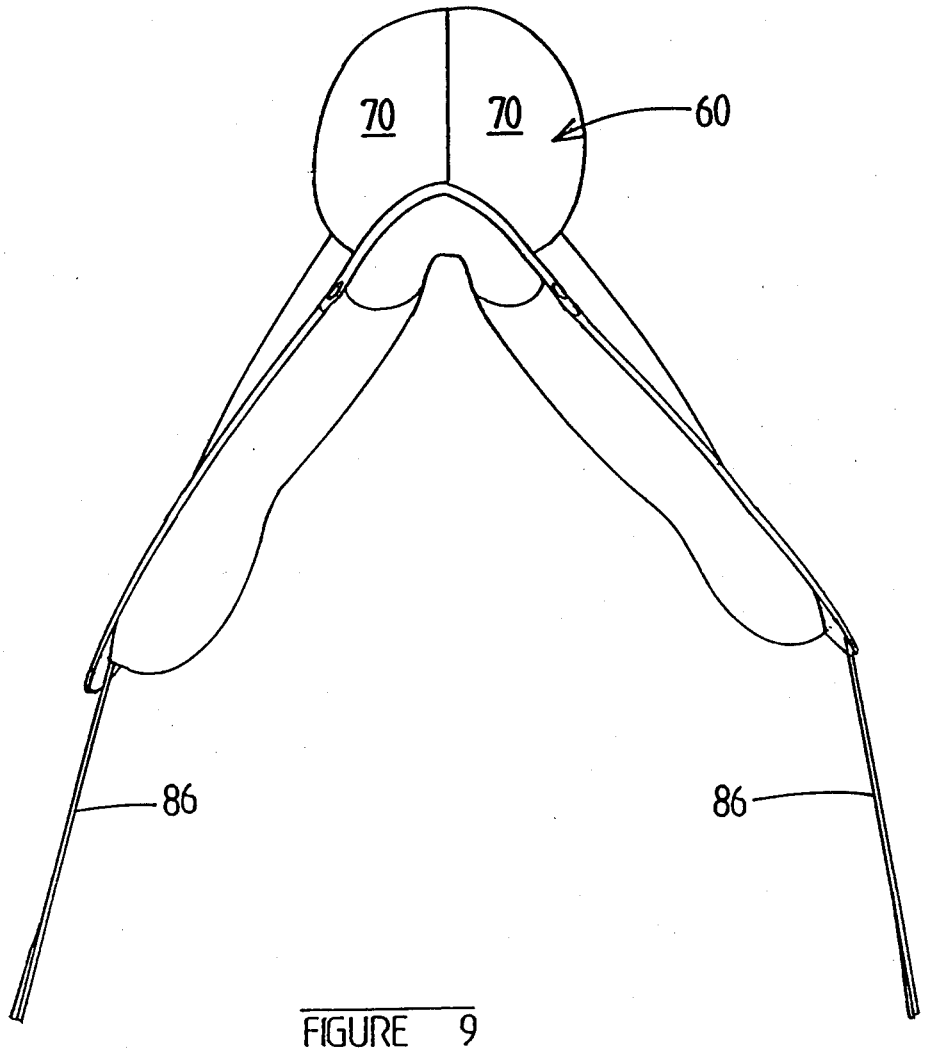
FIG. 9 is a front elevation of the second embodiment.

In the embodiment shown in FIGS. 1 to 6 of the drawings a light "racing saddle" can be constructed in a variety of colours by selecting the required coloured cloth covered high density foam sheet. The sheet foam preferably being cloth covered cross linked closed cell polyethylene foam which is marketed under the trade mark of "Softlon". A saddle is constructed by firstly pressing or stamping from a single sheet member the upper saddle covering 11 comprising the seat 13, backs 15 and upper flaps 17. Preferably the right hand side 19 and the left hand side 21 are stamped out separately as shown in FIG. 1 of the drawings. The two separate halves are stitched together down the central longitudinal seam 23 to form the complete upper saddle covering shown in FIG. 3. During the stitching of the two halves together strengthening or decorative stitching 25 can also be applied to the upper covering 11. Similarly, the underside saddle covering 27 is pressed in two separate halves 27A and 27B including the panel 29, lining 31 and underflaps 33. The two separated halves are shown in FIG. 2 of the drawings and joined as one underside saddle covering in FIG. 4. The upper 11 and underside saddle covering 27 are then secured to a saddle tree 39, preferably by glueing, and the saddle construction completed by stitching the upper 11 and lower or underside saddle covering 27 together around the periphery 37 of the head or gullet 35 and the periphery 41 of the seat 13.

Alternatively the construction technique may be varied so that the upper 11 and the underside saddle covering 27 are secured together around the periphery of the cantle 35 to form a pocket (not shown). The joining stitching 37 has been shown in FIGS. 3 and 4 of the drawings. A saddle tree 39 is inserted into the pocket formed between the upper and underside coverings and encased into position by securing the upper and underside coverings together around the periphery of the seat 13.

This method of construction enables a quantity of stamped or pressed components to be forwarded to a machinist together with the necessary number of saddle trees. The machinist with very little experience in saddlery is then, very quickly and economically, able to construct a saddle. The need for heavy industrial sewing machines is eliminated and so is the requirement for experienced machinists. The sheet material being utilised is extremely light, hard wearing and comfortable to both horse and rider.

In addition, jockeys in the racing fraternity can have their own selected coloured riding saddles to match the coloured silks they wear.

With reference to FIGS. 7 to 12, a general-purpose saddle comprises a saddle tree preferably formed by injection molding, with a cantle attachment to form the seat back, the upper surface of the tree and cantle being covered with a sheet of resilient foam. A reinforcing metal bar extends across the underside of the tree at the head end to reinforce the tree.

The seat 60, flaps 62 (also known as the upperflaps), panel 64 and underflaps 66 of the saddle are formed from pieces of composite sheet material stitched together to form a rearwardly open pocket into which the tree is inserted, with the seat and panel being "laced-in" or stapled to the lateral and rear parts of the tree. The composite sheet material from which these components are formed consists of opposed outer layers of a wear-resistant synthetic fabric, bonded to an intermediate layer of a resilient synthetic foam. Preferably the outer fabric layers consist of nylon and the intermediate layer consists of cross-linked closed cell polyethylene foam. Preferably the components are formed by pressing from a sheet of the composite material.

The seat 60 and flaps 62 are formed as an integral unit from two symmetrical sections 70 of the sheet material stitched together along the longitudinal centre line of the seat. A collar-like section 72 is stitched to the rear edges of the seat sections 70 to overlie the back of the seat part of the tree.

Figure 10:
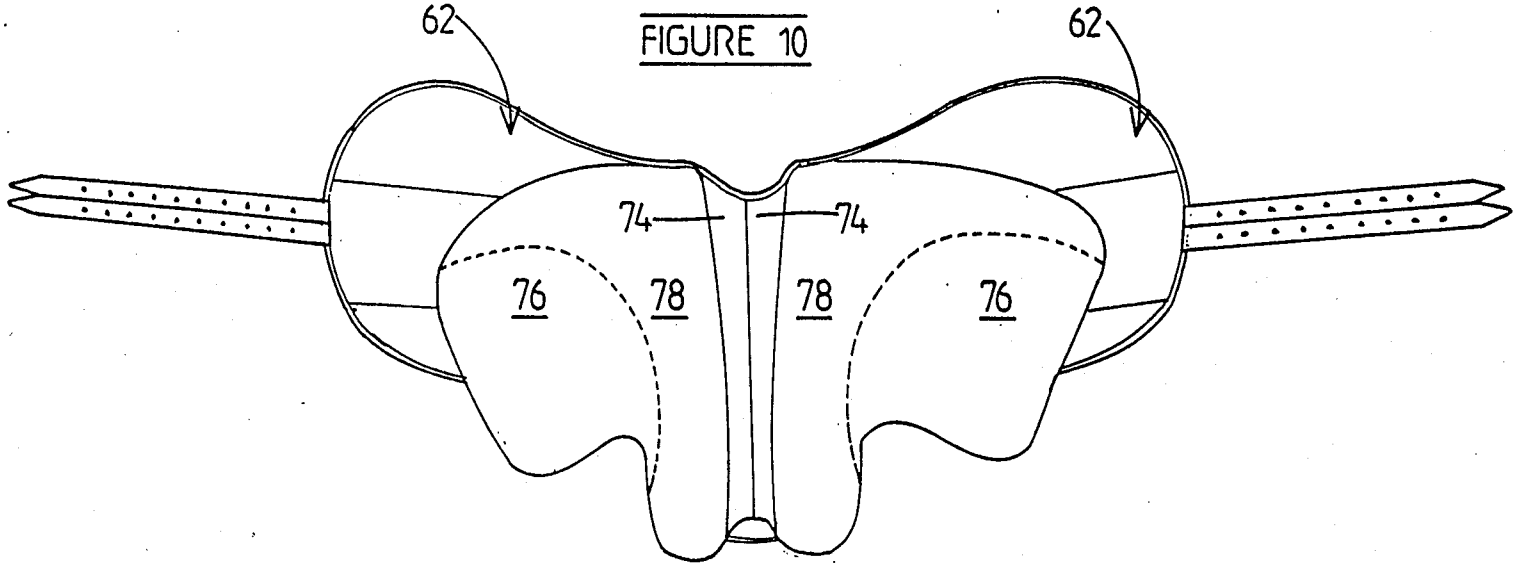
FIG. 10 is an underside plan view of the second embodiment.
Figure 11:
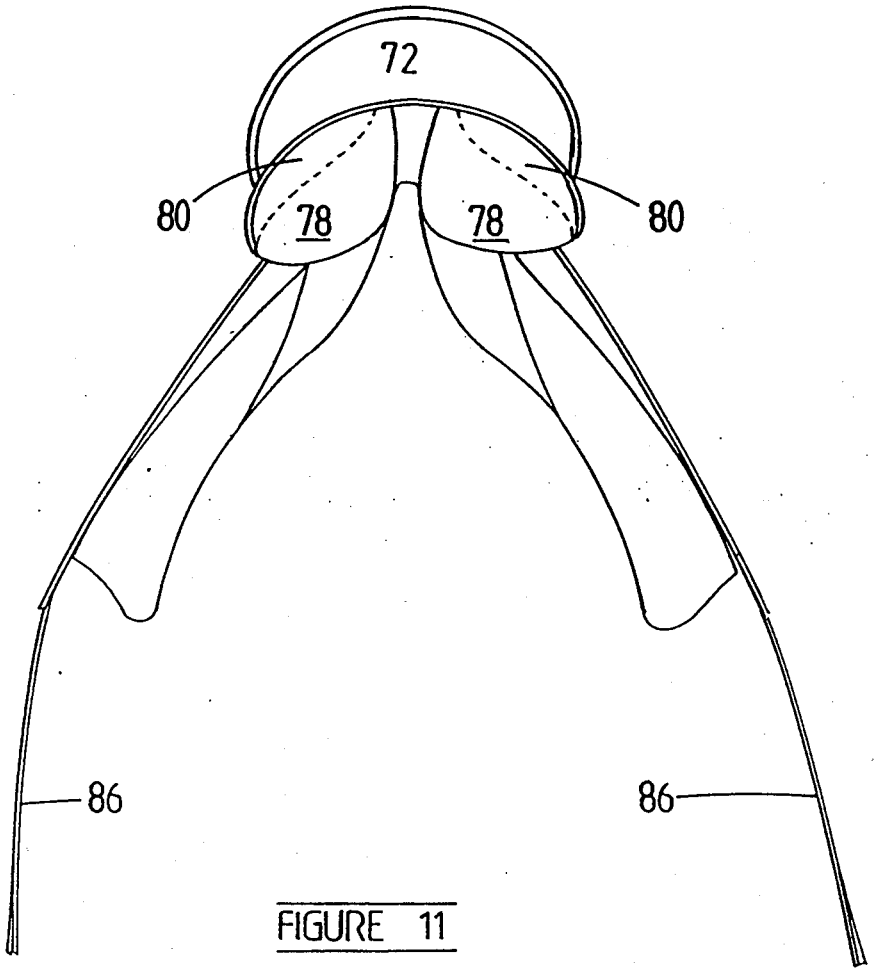
FIG. 11 is a rear elevation of the second embodiment.

The panel and underflaps 64, 66 are also formed as an integral unit from several sections of the sheet material symmetrical about the longitudinal centreline of tree. As shown in FIG. 10, the panel and underflap unit comprises two elongate strip-like portions 74 stitched together along the longitudinal centreline of the tree. The outer edge of each strip-like portion 74 is stitched to a main panel portion 76. The upper surface of each main panel portion is stitched to a secondary panel portion which overlies the main panel portion and defines therewith a pocket 78 which receives wool flock stuffing and/or a foam insert in order to produce the padded, bulging, panel configuration as clearly shown in FIGS. 7, 8, 9 and 11. Gusset strips 80 at the front and rear of the pockets 78, and stitched to the main and secondary panel portions enable the pockets 78 to take up the bulging configuration when filled.

To assemble the saddle the preformed seat and flap unit is stitched to the preformed panel and underflap unit in a zone corresponding to the head of the tree to form a rearwardly open pocket into which the tree is received, downwardly directed points at the head of the tree being received in point pockets 82 (FIG. 12) formed in the panel and underflap unit. The seat and flap unit is laced-in or stapled to the underside of the tree at lateral zones forwardly of the cantle, and the collar-like section 72 and the panel and underflap unit are laced-in or stapled to the underside of the tree at the back of the seat.

Figure 12:
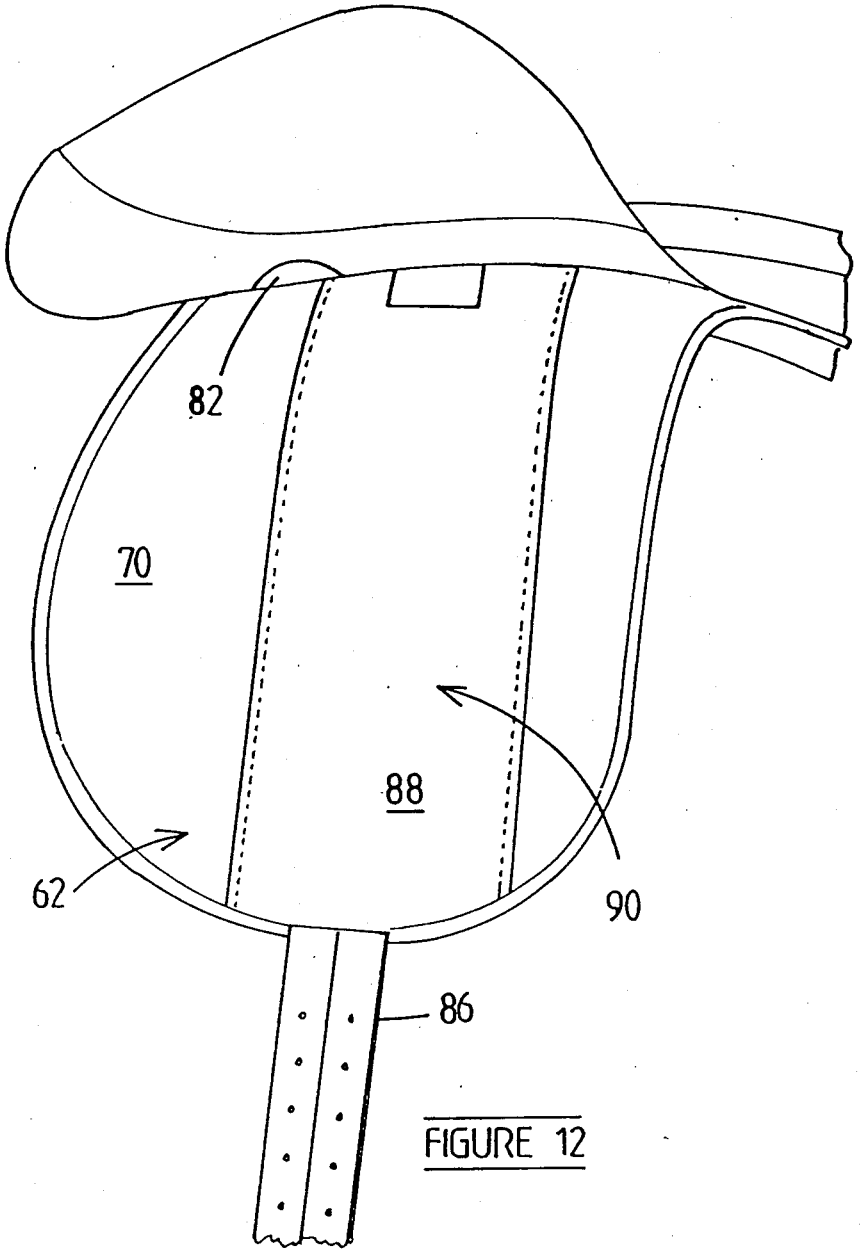
FIG. 12 is a fragmentary underneath view of the second embodiment as viewed from one side.

Girth straps 86 extend through pockets 88 formed on the underside of the flaps 62 as shown in FIG. 12, the left and right straps being connected by webbing which runs over the tree. The pocket 88 may be defined by an elongate panel of synthetic leather stitched to the underside of the flap 62 as shown at 90. A similar elongate panel 92 may be stitched to the upper surface of each flap 62. The panels 90, 92 lie in the zone of maximum wear, where the thighs and legs of the rider grip the saddle. Tongues 94 (FIGS. 7 and 8) are cut out of the flaps 62 at opposite sides of the tree to provide access to the saddle bars which are formed in the tree to receive the stirrup leathers.

The saddle described is relatively inexpensive to produce and considerably lighter in weight than a conventional leather saddle, but has good wear characteristics and provides the rider with a "feel" comparable with that of a conventional saddle. This is primarily achieved by the use of the composite sheet material described herein.

A modified form of saddle which is more similar in appearance to a conventional saddle comprises a seat and skirt unit formed from two symmetrical sections of the sheet material and stitched along the centreline of the seat, each section being a single piece of the composite material which forms half of the seat and the adjacent skirt. The seat and skirt unit is attached to the tree, with each flap being formed from a separate piece of the composite material attached to the tree beneath the seat and skirt unit. The panel and underflap unit is formed as described above.

We claim:

1. A saddle comprising a saddle tree formed from a material forming substantially the sole structural element of said saddle, an upper saddle covering including a seat and upper flaps, and an underside saddle covering including a panel and under flaps, said saddle coverings being carried by the saddle tree, the improvement comprising at least upper flaps being formed in part from a composite sheet material consisting of a cloth-covered foam with the cloth facing outwardly and facing the legs of the rider and a wear strip affixed to said upper flaps and positioned to be engaged by the legs of the rider and formed from a more wear resistant material than said composite sheet material.

2. A saddle according to claim 1 further including a strap for affixing the saddle to the horse, said strap being fixed to said under flaps maintaining said under flaps in proximity to the body of the horse.

3. A saddle according to claim 1, wherein the foam comprises a closed cell foam and the outer fabric layers consist of a synthetic fabric.

4. A saddle according to claim 1 wherein the upper saddle covering comprises a seat formed by two symmetrical sheet parts of the composite material stitched together along the longitudinal centre line of the seat, and the lower saddle covering comprises an integral panel and underflap unit formed by a plurality of sheet parts of the composite material stitched together.

5. A saddle according to claim 4, wherein the upper saddle covering comprises an integral seat and flap unit including two symmetrical sheet parts each forming one half of the seat and the adjacent flap.

6. A saddle according to claim 3, wherein the panel of the lower saddle covering includes pockets defined by layers of the composite sheet material, the pockets being filled with packing.

* * * * *